United States Patent [19]

Hamilton

[11] 4,192,171

[45] Mar. 11, 1980

[54] HAND HELD CRIMPING TOOL

[75] Inventor: Jerry W. Hamilton, Desoto, Tex.

[73] Assignee: Automatic Tool Company, Inc., Ferris, Tex.

[21] Appl. No.: 889,317

[22] Filed: Mar. 23, 1978

[51] Int. Cl.[2] ..... B21D 7/00; B21D 37/10

[52] U.S. Cl. ..... 72/416; 29/517; 72/454

[58] Field of Search ..... 72/416, 414, 410, 454, 72/402; 29/517, 234, 753, 761

[56] References Cited

U.S. PATENT DOCUMENTS

| | | | |
|---|---|---|---|
| 2,285,099 | 6/1942 | Specht | 72/454 |
| 2,903,929 | 9/1958 | McVey | 72/416 |
| 3,057,233 | 10/1962 | Turner | 72/416 |
| 3,251,216 | 5/1966 | Broske | 72/416 |
| 3,630,068 | 12/1971 | Floyd | 72/410 |
| 4,067,224 | 1/1978 | Birks | 29/517 |

FOREIGN PATENT DOCUMENTS

| | | | |
|---|---|---|---|
| 1951719 | 6/1970 | Fed. Rep. of Germany | 72/412 |

*Primary Examiner*—Francis S. Husar
*Assistant Examiner*—Gene P. Crosby
*Attorney, Agent, or Firm*—Gerald G. Crutsinger; John F. Booth; Harry C. Post, III

[57] ABSTRACT

A device for crimping a rigid, tubular ferrule for securing a coupling to a flexible hose comprising a pair of crimping dies, each die having a concave face and spaced ribs formed on each of the concave faces. The ribs have a ramp portion formed on opposite ends thereof and in the knotched central portion. The die support has a central web having a flange extending outwardly from each end, one of the flanges being adapted to hold one of the dies. The second die is moveable along a track formed on the central web defining a straight path toward the first die. A screw urges the moveable die along the track to engage the first die and perform the crimping operation.

4 Claims, 9 Drawing Figures

HAND HELD CRIMPING TOOL

BACKGROUND

Heretofore, two basic types of connectors have been employed for attaching ends of flexible hoses to a rigid threaded pipe. The flexible hoses have various applications, for example, on vehicle air conditioning systems Freon is circulated through the hoses.

The first type of fitting is generally referred to as a "crimp-type fitting". This type of fitting generally comprises a tubular ferrule having an inside diameter substantially equal to the outside diameter of the flexible hose end. The ferrule has a central tube secured therethrough having a barbed end which fits on the inside of the flexible hose. A threaded coupling is rotatably secured to the other end of the tube. When attaching the coupling to the end of the flexible hose, a tube is inserted inside the hose and the ferrule slips over the outside of the hose. It is necessary to crimp the ferrule over the outside of the hose urging the flexible hose into engagement with the barbs on the tube to form a seal between the tube and the flexible hose.

The other type of fitting comprises a tube having a barbed end which is inserted into the end of the flexible hose and a swivel coupling connected to the other end. A hose clamp is secured about the end of the hose over the area of the hose adjacent the barbs to urge the hose into engagement with the barbs. Problems have occurred with the use of this type of coupling in that the vibration from automobiles or equipment tends to loosen the hose clamp and thus allow the pressure from the fluid being carried by the flexible hose to blow out the tube thus causing a failure of the hose. This often leads to a shutdown of the equipment and could create a hazardous condition.

When the hoses are being used on air conditioning systems for automobiles a leak of this nature will allow the Freon to escape into the atmosphere. The average automobile system has between three and six pounds of Freon therein. The Environmental Protection Agency (EPA) has determined that the Freon is hazardous to the environment since the Freon tends to break down the ozone layer which protects the Earth's surface from excessive ultraviolet rays of the sun. The EPA has determined that the hose clamp type connections are not satisfactory for preventing leaks in Freon systems.

Heretofore, devices to crimp the ferrule of a coupling onto an end of a flexible hose have comprised large, stationary units having a segmented collet which is urged radially inwardly by a spacer ring which is moved by a hydraulic or air type cylinder. The hydraulic or air pressure must be supplied from a separate power source. These devices are not only expensive and impractical for the average small repair shop to use but also cannot be used as a hand tool under the hood of a vehicle.

In making repairs it is desirable to repair only that portion of the system which is leaking, in that removal of further connections may cause further problems within the system. Heretofore, it was necessary to remove both ends of the hose from the system of the vehicle to make the proper repairs to one end of a hose if a crimp type coupling was used.

Heretofore, no devices have been known which could be employed to satisfactorily crimp the ferrule onto the flexible hose under the hood of an automobile or on the vehicle itself. Devices heretofore utilized have comprised a "bolt cutter" configuration requiring long handles which can not be satisfactorily used in a limited area on the automobile. Further, the toggle or "bolt cutter" configuration does not have a uniform force throughout the range of movement of the handles and causes an oblong deflection of the ferrule as it is crimped onto the hose. This creates a void or weak spot due to uneven pressure between the ferrule and the hose which can leak. It is necessary to provide a tool which will give a uniform pressure radially inwardly about the entire circumference of the ferrule to urge the hose into engagement with the barbs on the tube.

SUMMARY OF THE INVENTION

I have devised a handheld crimping tool for crimping the ferrules on hose connectors used on the end of flexible hoses such as those types of connectors manufactured by Automatic Tool Company, Inc. in Ferris, Texas.

The crimping tool comprises a support body comprising a C-shaped body having a central web portion and a flange extending outwardly from each end of the central web portion. A pair of crimping dies are adapted to form the crimp, the dies comprising two die halves having a concave face having a pair of ribs. Each rib has a ramp formed on opposite ends thereof and a notched central portion formed therein.

A first die half is secured between first and second shoulders at opposite ends of a saddle formed in one of the upwardly extending flanges of the support and is secured there by a set screw. A second die half is secured in a moveable jaw between first and second shoulders at opposite ends of a saddle by a set screw. The moveable jaw is secured along a guide track which defines a straight path along which the second die is moved toward the first die. A threaded screw is threaded through a passage in the second flange and is secured in a bore formed in the moveable jaw. The screw engages a ball bearing in the bore and is secured by a pin which engages a groove in the shaft to limit movement of the screw out of the bore. By turning the screw, the moveable jaw is moved along the guide track relative to the first die half.

The support body may have a handle secured thereto or may be secured to a bench if desired.

The screw may be turned by hand wrench, an air impact wrench, or a rachet wrench allowing universal use by almost anyone to make a factory type leak-proof seal on a flexible hose.

A primary object of the invention is to provide a handheld tool capable of providing a tight, uniform seal of the ferrule against the hose and connector such that a factory type connection may be made under the hood of the car when repairing or replacing a connection.

Another object of the invention is to provide a tool for crimping the ferrule on the hose connections which may be used on the vehicle without removal of the hose from the vehicle.

Another object of the invention is to provide a small crimping tool which may be utilized in inconvenient, inexcessible places on the vehicle.

A further object of the invention is to provide a crimping tool which may be utilized off the vehicle and which may also be converted to use on different sizes of connectors and different types of connectors with a minimum of exchange of parts.

A still further object of the invention is to provide a crimping tool which is relatively inexpensive and may be utilized by smaller garages, thus, providing a factory type seal when repairing or manufacturing flexible hoses.

Other and further objects of the invention will become apparent upon referring to the detailed description hereinafter following and the drawings annexed hereto.

DESCRIPTION OF THE DRAWINGS

Drawings of two preferred embodiments of the invention are annexed hereto so that the invention may be better and more fully understood, in which.

Numeral references are employed to designate like parts throughout the various figures of the drawings.

DESCRIPTION OF A PREFERRED EMBODIMENT

Figure 2:
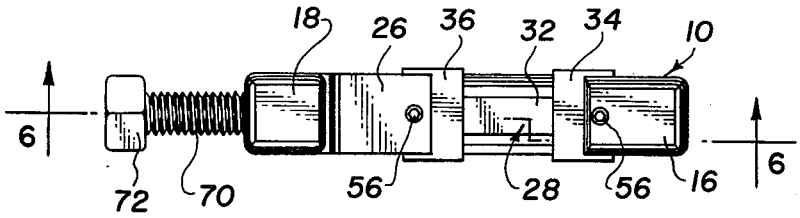
FIG. 2 is a top plan view thereof.
Figures 1, 3, 4:
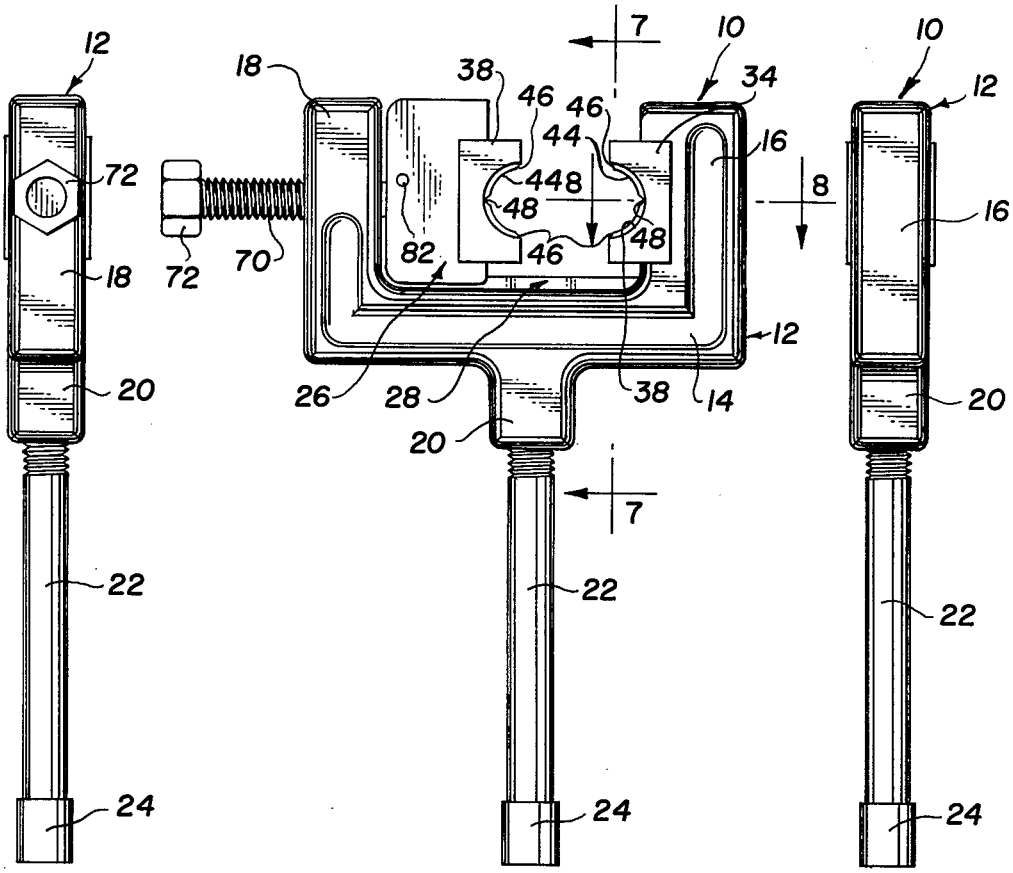
FIG. 1 is a front elevational view of the crimping tool with the crimping dies spread apart.
FIG. 3 is a left side elevational view thereof.
FIG. 4 is a right side elevational view thereof.
Figure 5:
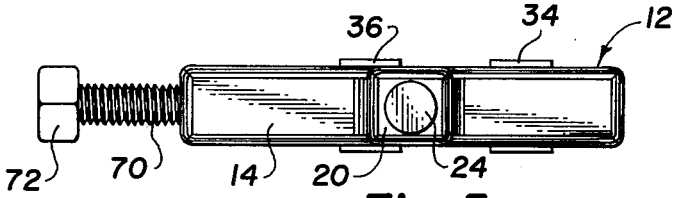
FIG. 5 is a bottom plan view thereof.
Figure 6:
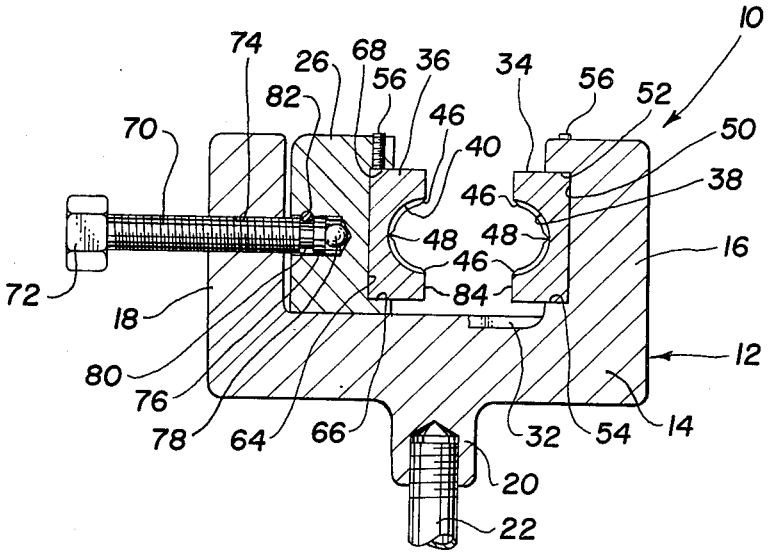
FIG. 6 is a cross-sectional view taken along line 6—6 of FIG. 2.
Figure 7:
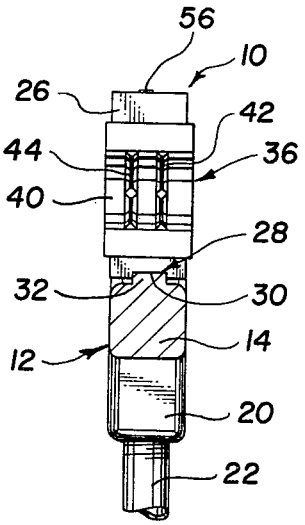
FIG. 7 is a cross-sectional view taken along line 7—7 of FIG. 1.
Figure 8:
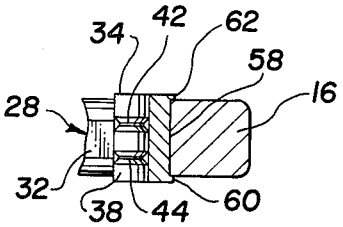
FIG. 8 is a cross-sectional view taken along line 8—8 of FIG. 1.

Referring to the drawings, the numeral 10 generally designates the crimping tool having a support means comprising a C-shaped body 12 having a central web portion 14 with outwardly extending flanges 16 and 18 on each end thereof.

The C-shaped body 12 has an internally threaded extension 20 to which a tubular handle 22 having an end 24 is threadedly secured. The handle 22 provides a means to grip the tool 10 for limiting rotation when using the tool.

Flange 16 forms a first fixed jaw and a second moveable jaw 26 is slideably disposed along guide means such as guide track 28 to define a straight path toward the first fixed jaw flange 16. Moveable jaw 26 generally comprises a rectangular shaped block having a groove 30 formed in the lower portion which is complimentary to a raised central portion 32 forming guide track 28. A pair of crimping dies 34 and 36 form a first fixed die half and a second moveable die half and each has a concave face 38 and 40 having a pair of raised ribs 42 and 44 formed circumferentially on concave faces 38 and 40. A ramp portion 46 is formed on opposite ends of each rib 42 and 44 on each concave surface 38 and 40 and notched central portions 48 are formed in each rib 42 and 44.

Crimping die 34 is positioned in a saddle 50 having a pair of spaced shoulders 52 and 54 at opposite ends of die 34. Locking means to secure die 34 in saddle 50 generally comprises a set screw 56. A groove 58 is formed in the rear edge of die 34 to provide spaced projections 60 and 62 extending along the rear edge thereof to engage saddle 50 such that saddle 50 and groove 58 are complimentary of each other to limit movement relative to each other.

Crimping die 36 is secured in saddle 64 having spaced shoulders 66 and 68 on opposite ends of crimping die 36. Crimping die 36 has a groove 58 and spaced projections 60 and 62 similar to the rear edge of crimping die 34. A set screw 56 provides a means to hold the crimping die 36 in saddle 64.

Means to move the moveable jaw 26 generally comprises a threaded shaft 70 having a head 72 which is threadedly secured through passage 74 and secured in bore 76 against a ball bearing 78 in the bottom of bore 76. A groove 80 is formed adjacent the end of shaft 70 and pin 82 passes through the side of moveable jaw 26 to provide a means rotatably securing the end of shaft 70 in bore 76.

Operation of the hereinbefore described device is as follows:

The handheld crimping tool 10 is generally adapted to crimp a metal ferrule which is slideably disposed over the end of a flexible hose to form a connector secured to the end of the flexible hose. The ferrule has a ribbed tube which is disposed centrally therethrough having a swivel connector on the end thereof such as the type manufactured by Automatic Tool Company, Inc. of Ferris, Texas.

A connector is positioned on the end of a flexible hose such that the rigid externally ribbed tube extends inside the hose and the tubular hollow ferrule extends around the outside of the end of the hose such that the ribbed portion and the ferrule engage the inner and outer walls of the flexible tube in the same position. The tool is positioned around the ferrule such that the first die half is in engagement with one side of the ferrule and the second die half is moved along a projection of the diameter of the ferrule such that it engages the other half of the ferrule. The first and second die halves are moved together by turning screw 70 to move moveable jaw 26 inwardly along the projection of the diameter of the ferrule. Ramps 46 and notched central portions 48 form spaced creases in the ferrule to prevent distortion of the ferrule as it is urged inwardly into engagement with the end of the flexible hose. As the flat portions 84 of dies 34 and 36 meet, a ferrule crease is completed by ribs 42 and 44.

The moveable jaw 26 is moved outwardly by reversing the direction of shaft 70. The tool 10 may be removed from the hose connection and the connection is complete.

It should be readily apparent that the hex headed head 72 on shaft 70 may be turned by a conventional hand wrench, a ratchet socket wrench, or by using an air impact wrench to drive the moveable jaw inwardly and outwardly along track 28.

The arrangement of the dies 34 and 36 provide an even distribution of pressure about the entire circumference of the flexible hose and provides enough force to sufficiently crimp the ferrule to urge the end of the hose into engagement with the ribbed portion of the tube.

Figure 9:
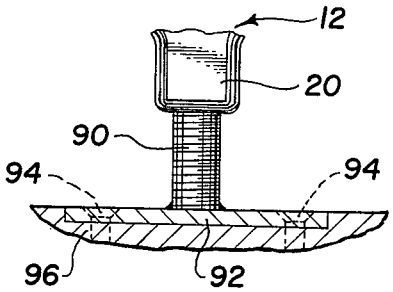
FIG. 9 is a modified form of the mounting base.

As best illustrated in FIG. 9, a modified support may be provided such that the internally threaded projection 20 on body 12 may be mounted on a threaded stud 90 which is welded or otherwise secured to a plate 92. Plate 92 may be mounted by screws 94, shown in dashed outline, to a bench member 96 or the wall. This provides a method of holding the support means 12 in instances where a permanent location of the crimping tool 10 is desired.

It should be readily apparent that the device hereinbefore described accomplishes each of the objects hereinbefore discussed.

It should be readily apparent that other and further embodiments of the invention may be devised without departing from the basic concept thereof.

I claim:

1. A device for crimping a rigid, tubular ferrule for securing a coupling to a flexible hose comprising: support means a central web on said support means; a guide track extending longitudinally of said web; a first jaw on said support means, said first jaw extending outwardly from said web; a flange on said support means, said flange extending outwardly from said web in spaced relation from said first jaw; a second jaw; means moveably securing said second jaw to said guide track; means secured between said flange and said second jaw for moving said second jaw along said guide track; a saddle formed in each of said first and second jaws, each of said saddles having a pair of spaced shoulders adjacent ends thereof; a pair of crimping dies, each of said crimping dies having a groove formed therein so as to provide spaced projections extending along edges of each of said dies, said saddles and said grooves being complimentary such that opposite ends of said dies engage said shoulders to limit movement of said dies in a first direction and such that said projections engage said jaws adjacent opposite sides of said saddles to limit movement in a second direction; and locking means detachably securing said crimping dies in said saddles.

2. A device for crimping a rigid, tubular ferrule for securing a coupling to a flexible hose according to claim 1, each of said crimping dies having a concave face; spaced ribs on each of said concave faces, each of said ribs having a ramp portion formed on opposite ends thereof, each of said ribs further having a notched central portion intermediate opposite ends thereof.

3. A device for crimping a rigid, tubular ferrule for securing a coupling to a flexible hose comprising: a pair of crimping dies, each of said crimping dies having a concave face; spaced ribs on each of said concave faces, each of said ribs having a ramp portion formed on opposite ends thereof; handheld support means; a central web on said handheld support means; a guide track extending longitudinally of said web; a fixed jaw on said handheld support means extending outwardly from said web; means securing a first of said pair of crimping dies to said fixed jaw; a flange on said central web, said flange extending outwardly from said web in spaced relation from said fixed jaw; a moveable jaw having a bore formed therein; means moveably securing said moveable jaw to said guide track; means securing a second of said pair of crimping dies to said moveable jaw; screw means secured between said flange and said moveable jaw for moving said moveable jaw along said guide track to move said second crimping die along a straight path toward and away from a first of said crimping dies; a ball bearing in said bore in said second jaw, said ball bearing engaging said second jaw and the end of said screw means to move said second crimping die along a straight path; and means rotatably securing the end of said screw means in said bore.

4. A device for crimping a rigid, tubular ferrule for securing a coupling to a flexible hose comprising: a pair of crimping dies, each of said crimping dies having a concave face; spaced ribs on each of said concave faces, each of said ribs having a ramp portion formed on opposite ends thereof; support means; a central web on said support means; an outwardly extending fixed jaw on one end of said central web portion; a flange on the other end of said central web portion; a moveable jaw having a groove formed therein; a guide track on the central web portion of said support means, said guide track extending longitudinally of said support means and into said groove in the moveable jaw; means rigidly securing one of said crimping dies to said fixed jaw; means rigidly securing the other crimping die to said moveable jaw, said first and second crimping dies being restrained against rotation relative to each other; a threaded screw extending through an aperture in said flange, said screw engaging said moveable jaw to move said moveable jaw and the crimping die secured thereto toward and away from the crimping die secured to the fixed jaw; and a handle secured to said central web portion to limit rotation of the central web portion when said threaded screw is rotated for moving the moveable jaw along the guide track.

* * * * *